US010989507B2

(12) United States Patent
Thompson

(10) Patent No.: US 10,989,507 B2
(45) Date of Patent: Apr. 27, 2021

(54) SYSTEMS AND METHODS FOR MATCHING OGIVE TWIST AND BARREL TWIST

(71) Applicant: Mark Thompson, Providence, UT (US)

(72) Inventor: Mark Thompson, Providence, UT (US)

( * ) Notice: Subject to any disclaimer, the term of this patent is extended or adjusted under 35 U.S.C. 154(b) by 0 days.

(21) Appl. No.: 16/261,148

(22) Filed: Jan. 29, 2019

(65) Prior Publication Data

US 2020/0240758 A1 Jul. 30, 2020

(51) Int. Cl.
*F42B 10/24* (2006.01)
*F42B 30/02* (2006.01)
*F42B 10/46* (2006.01)

(52) U.S. Cl.
CPC ..... *F42B 10/24* (2013.01); *F42B 30/02* (2013.01); *F42B 10/46* (2013.01)

(58) Field of Classification Search
CPC ..... F42B 10/24; F42B 14/02; F42B 10/26
USPC ..... 102/501, 524, 508, 509, 514, 439, 516, 102/515, 507; 89/14.7
See application file for complete search history.

(56) References Cited

U.S. PATENT DOCUMENTS 484,008 A * 10/1892 Haskell ..... F42B 14/02 102/524
910,935 A * 1/1909 Meyer ..... F42B 14/02 102/524
1,659,625 A * 2/1928 Cowan ..... F42B 5/02 42/78
4,996,924 A 3/1991 McClain
5,164,538 A 11/1992 McClain
5,200,573 A 4/1993 Blood
5,737,863 A * 4/1998 Rainey, III ..... F41C 9/08 42/51
6,439,125 B1 8/2002 Carter
9,488,453 B2 11/2016 Dikhoff
2007/0074637 A1 4/2007 Pontieri
2015/0354932 A1 12/2015 Schnabel
2017/0314900 A1* 11/2017 Mahnke ..... F42B 10/22

FOREIGN PATENT DOCUMENTS

WO 2015200934 12/2015
WO 2017197504 11/2017

* cited by examiner

*Primary Examiner* — Reginald S Tillman, Jr.

(74) *Attorney, Agent, or Firm* — Dax D. Anderson; Kirton McConkie

(57) ABSTRACT

A bullet with grooves to create more surface area to reduce drag, thus keeping a flatter trajectory that reduces the effects of wind, temperature, elevation and angle. Groves would be manufactured into the bullet and bullet jacket twist would need to match the barrel twist. For example, 1 in 8 twist, 1 in 8½ twist, 1 in 9 twist, 1 in 10 twist, 1 in 11 twist etc. Groves would be over the ogive of the bullet prior to where the bullet contacts the barrel wall.

19 Claims, 2 Drawing Sheets

SYSTEMS AND METHODS FOR MATCHING OGIVE TWIST AND BARREL TWIST

CROSS-REFERENCE TO RELATED APPLICATIONS

The application does not have a related application.

TECHNICAL FIELD

The present disclosure relates generally to external ballistics on a projectile. More particularly, the disclosure relates to matching grooves in the ogive of a projectile to the twist in the rifling of a barrel.

BACKGROUND

A bullet is the projectile expelled from a firearm during firing. To optimize accuracy and distance a bullet must balance internal ballistics (forces inside the gun) and external ballistics (forces acting on the bullet after leaving the muzzle of a gun). A projectile shot from a gun tends to tumble through the air. Bullet spin, ie stabilization, stabilizes the orientation of the projectile in flight. However, stabilization must be balanced: overstabilized bullets and understabilized bullets are less accurate than correctly stabilized bullets. However, under current systems and methods, projectile spin only occurs while the bullet is in contact with bore rifling. Therefore a need exists to correctly stabilize the bullet outside the bore.

BRIEF SUMMARY

The general purpose of the systems and methods disclosed herein is to provide improved internal and external ballistics. Specifically, disclosed herein are systems and methods for constructively extending barrel rifling beyond the physical barrel so that a bullet begins to spin prior to contacting the rifling, as well as maintain correct spin after exiting the barrel rifling. The overall apparatus comprises structural features on the surface of a bullet ogive which match the twist rate of the barrel rifling. This apparatus is designed to work in conjunction with a variety of existing rifles barrels.

In some embodiments, the apparatus comprises grooves formed in the ogive of a bullet. In some embodiments raised channels are formed on the ogive which match the twist of the barrel firing the bullet.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment, but may refer to every embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention. Accordingly, there exists a need to for a bullet with grooves formed in the ogive which match the rifling twist rate of the barrel used to fire the bullet.

The features and advantages of the present disclosure will become more fully apparent from the following description and appended claims, or may be learned by the practice of the invention as set forth hereinafter.

BRIEF DESCRIPTION OF THE DRAWINGS

In order to describe the manner in which the advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1A:
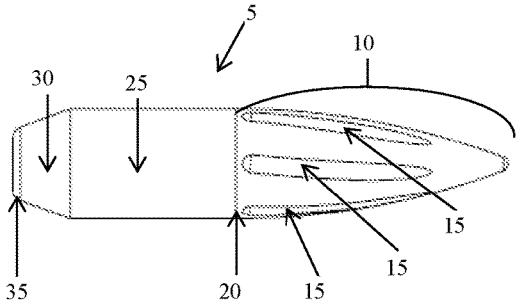
FIG. 1A illustrates side view of bullet with ogive grooves.
Figure 1B:
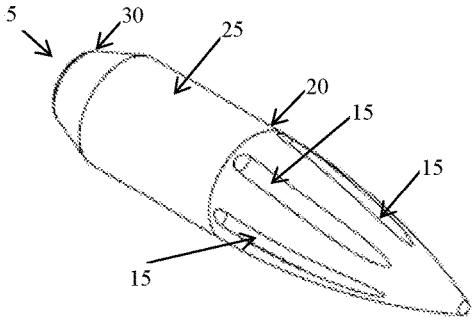
FIG. 1B illustrates perspective view of bullet with ogive grooves.
Figure 1C:
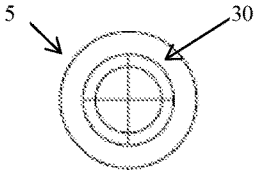
FIG. 1C illustrates heel view of bullet with ogive grooves.
Figure 1D:
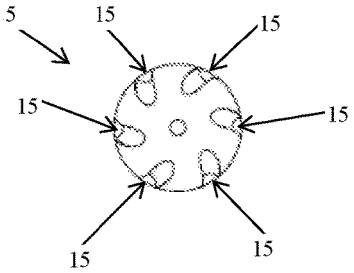
FIG. 1D illustrates nose view of bullet with ogive grooves.
Figure 1E:
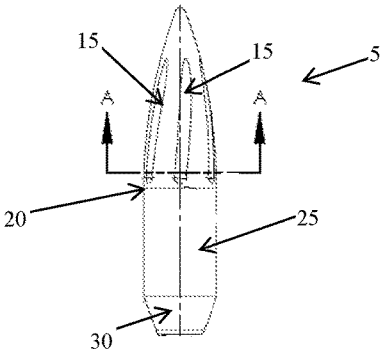
FIG. 1E illustrates side view of bullet with ogive grooves with a cross-sectional line A-A.
Figure 1F:
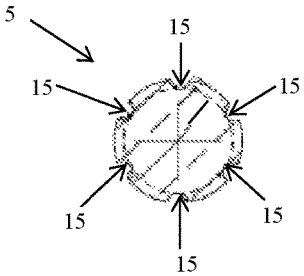
FIG. 1F illustrates cross-section line A-A with ogive grooves.
Figure 1G:
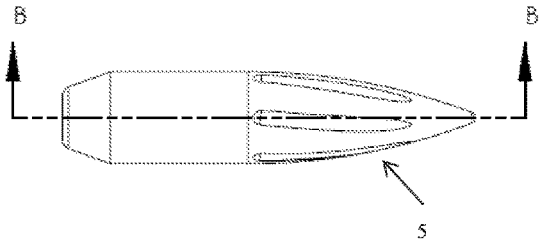
FIG. 1G illustrates side view of bullet with ogive grooves with a cross-sectional line B-B.
Figure 1H:
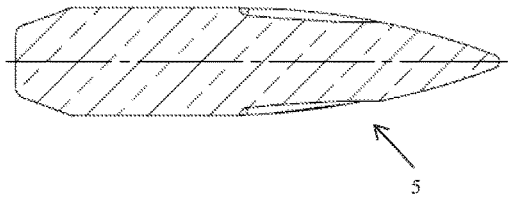
FIG. 1H illustrates cross-section line B-B with ogive grooves.
Figure 2A:
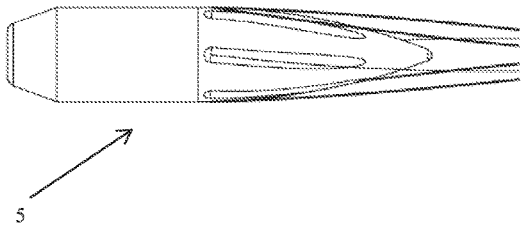
FIG. 2A illustrates side view of ogive groove lines projected beyond the nose of the bullet.
Figure 2B:
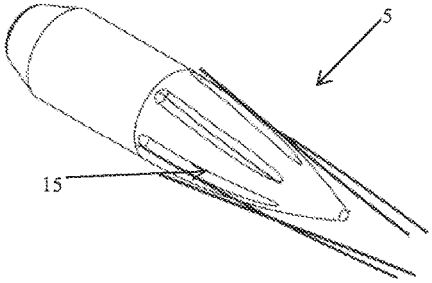
FIG. 2B illustrates perspective view of ogive groove lines projected beyond the nose of the bullet.

The present embodiments of the present disclosure will be best understood by reference to the drawings, wherein like parts are designated by like numerals throughout. It will be readily understood that the components of the disclosed invention, as generally described and illustrated in the figures herein, could be arranged and designed in a wide variety of different configurations. Thus, the following more detailed descriptions of the embodiments of the apparatus, as represented in FIGS. 1A-2B are not intended to limit the scope of the invention, as claimed, but are merely representative of present embodiments of the invention.

In general, the figures disclose an invention that provides a bullet with ogive grooves formed therein which match the rifling in the barrel used to fire the bullet.

In the following description, numerous references will be made to bore or barrel rifling and, freebore, firing chamber and other firearm structures, but these items are not shown in detail in the figures. However, it should be understood that one of ordinary skill in the art and in possession of this disclosure, would readily understand how the present disclosure and existing bullet structures can be incorporated.

Detailed references will now be made to embodiments of the disclosed invention, examples of which are illustrated in FIGS. 1A-2B which illustrate various views of a bullet 5 comprising ogive grooves 10 in accordance with one or more embodiments of the invention.

As the propellant explodes gasses form and expand, creating intense pressures. A bullet must form a seal with the gun's bore to contain that pressure and use it to propel the bullet. If a strong seal is not achieved, gas from the propellant charge leaks past the bullet, thus reducing pressure driving the bullet, which impacts the accuracy and force. The bullet must also engage the rifling without damaging or excessively fouling the gun's bore, and without distorting the bullet, which will also reduce accuracy. Bullets must have a surface that forms this seal without excessive friction. In addition, bullets must be produced to a high standard, as surface imperfections can affect the repeatability of firing accuracy.

External ballistics deal primarily with the forces acting on the projectile after it exits the muzzle of the gun, including the aerodynamics in flight, the bullet's shape and the bullet's rotation imparted by the rifling of the gun barrel. Proper rotational forces stabilize the bullet gyroscopically as well as aerodynamically. Too much rotation will over-stabilize the bullet causing poor aerodynamics. Too little rotation will under-stabilize the bullet allowing it to tumble through the air. Any defect or asymmetry in the bullet is largely canceled as it spins. However, a spin rate greater than the optimum value magnifies the smaller asymmetries or sometimes resulting in the bullet disintegrating in flight. Generally, bullet shapes are a compromise between aerodynamics, interior ballistic necessities, and terminal ballistics requirements.

There are many bullet shapes, but most modern bullets have common elements start with the ogive. The ogive is the curved area to the front of the projectile extending from the tip or meplat to the main cylindrical portion, and the radius involved. The main cylindrical portion of the bullet is the bearing surface 25 and is the surface of the bullet that makes contact with the grooves in the bore. The diameter of the bearing surface 25 is the bullet's caliber. The cannelure 20 is the groove around the outside circumference of a bullet. The back end of the bullet is called the heel 35. Many modern bullets have a feature called a boat tail 30 where the base tapers down to a smaller diameter.

In firearms, the helical pattern of lands and grooves machined into the bore surface of a gun's barrel is called rifling. Once a bullet is filed rifling engages the bearing surface 25 of a projectile so as to exert a torque force on a projectile as it passes through the bore of a barrel, causing the projectile to spin around its longitudinal axis during flight. Spin gyroscopically stabilizes the projectile by conservation of angular momentum, improving its aerodynamic stability and accuracy over smoothbore designs.

The rifling grooves helix is expressed in a twist rate of turns per inch to either the right or left. Rifling is described by its twist rate ie the distance the rifling takes to complete one full revolution. This is often expressed as "1 turn in 10 inches" (1:10 inches). Shorter distance indicates a "faster" twist, meaning that for a given velocity the projectile will be rotating at a higher spin rate.

The length, weight and shape of a projectile dictate the required twist rate needed to stabilize it in flight. Larger caliber bullets are stable at slower twist rates, while smaller caliber bullets require more twist to remain stable through flight. Twist rate may range from a very low twist rate, such as 1 turn in 48 inches for balls, to lin 8 for long, small-diameter bullets.

Some rifled barrels contain one or more grooves that run down its length, though it can also take the shape of a polygon, usually with rounded corners. Rifled bores may be described by the bore diameter (the diameter across the lands or high points in the rifling), or by groove diameter (the diameter across the grooves or low points in the rifling). Different manufacturers manufacture bores with a wide variety of grooves, odd or even number of grooves and grooves in different shapes. Bores have been manufactured with two grooves, three grooves, four grooves, 5 grooves, six grooves, seven grooves and eight grooves. Some bores are manufactured with 12, 16, 22 and 24 grooves.

The number and depth of grooves directly impacts the amount of pressure formed behind the bullet. Two groove barrels create a small amount of increased pressure. In some embodiments of a two groove barrel the lands cover $5/8^{th}$ of the bore. Some four-groove, six-groove and eight-groove barrels have grooves and lands that are a fraction the width of the two-groove barrels and use $1/4^{th}$ of the circumference of the bore. Due to the lands only covering $1/4^{th}$ of the bore circumference they are too narrow to guide a projectile such as a cast bullet nose. Optimized performance required groove-sized bodies and optimized bullet lengths. In some barrels the width of lands and grooves is equal, with each occupying ½ of the barrel. Counterintuitively, twist does not significantly influence pressure.

Grooves are normally in the area of 0.004 to 0.006 inches in depth. Shallow grooves are preferable because the bullet will not fill deep grooves and seal in pressure. The amount of energy used to force bullet seated in deep grooves would reduce velocity and increase pressure, temperature and wear in the barrel. There are many types of rifling. Some rifling comes with rounded grooves. Some rifling has grooves that are wider than the lands. Some rifling is parabolic. Another twist is gain twist, where the rifling increases in twist as it advances from the leade or throat to the muzzle. For example, the twist begins slow e.g. 1 in 37 and progresses to a fast twist of 1 in 10. Some rifling changes groove depth as it progresses down the barrel.

Rifling accurately delivers the projectile to the target by providing spin to the bullet. Bullet spin is accomplished when the barrel holds the projectile securely and concentrically as it travels down the barrel. As a result rifling must be consistent down the length of the bore without changes in cross-section, such as variations in groove width or spacing, and the chamber and crown must smoothly transition the projectile into and out of the rifling.

In some embodiments rifling may not begin immediately forward of the chamber. There may be an unrifled leade or throat ahead of the chamber so a cartridge may be chambered without pushing the bullet into the rifling. The specified diameter of the throat may be somewhat greater than groove diameter. When a cartridge is in the chamber there may be an area ahead of the bullet before the rifling called the free-bore or jump. The free-bore can be an extension of the chamber or ahead of it. Free-bore has straight walls with no taper. It is sometimes called a long throat chamber, even though it does not have much length. Free-bore is a groove-diameter length of smoothbore barrel without lands forward of the throat. Free-bore allows the bullet to transition from static friction to sliding friction and gain linear momentum prior to encountering the resistance of increasing rotational momentum. Free-bore may allow more effective use of propellants by reducing the initial pressure peak during the minimum volume phase of internal ballistics before the bullet starts moving down the barrel.

In some embodiments free-bore improves ballistics by allowing the bullet to leave the casing straight and overcoming its inertia and reaching a higher velocity prior to encountering the rifling. In some embodiments the resistance force created by the bullet engaging the rifling is more easily overcome when the bullet is properly aligned and the bullet hits the bore at speed.

When the projectile is swaged into the rifling, the bearing surface 25 is marked by the lands such that the projectile takes on the mirror image of the rifling, as the lands engrave into the projectile. Engraving takes on not only the major features of the bore, such as the lands and grooves, but also minor features, like scratches and tool marks.

In breech-loading firearms, the area immediately ahead of the chamber that is cut on a taper by the chamber reamer is called the throat. The throat aids the bullet in fitting into the bore.

Upon firing, the propellant explode to great high pressures in the chamber behind the bullet, forcing the bullet to pass the throat, then the freebore to engage the rifling where it is engraved, and begins to spin. Engraving the projectile requires a significant amount of force, and in some firearms there is a significant amount of freebore, which helps keep chamber pressures low by allowing the propellant gases to expand before being required to engrave the projectile. Minimizing freebore improves accuracy by decreasing the chance that a projectile will distort before entering the rifling.

Accuracy depends on several factors, bullet seating plays a major role, particularly on pressure and velocity. Bullet seating can be changed to increase the freebore. In some embodiments, where a bullet is seated with about 1/32nd of an inch gap between the bullet and the initial contact with the rifling, pressure builds very evenly as the bullet enters the barrel rifling. Pressure is constant while the propellant burns, and the velocity obtained is normal.

In some embodiments, increasing the freebore by seating the bullet deeper in the casing provides increased travel before entering the bore and making contact with the rifling, giving the bullet an opportunity to increase both its velocity and its spin in the freebore. The propellant have more space in which to expand as they burn without resistance from the rifling, and as a result, the pressure in the chamber does not achieve the normal" level and the bullet velocity is lower.

In contrast, in some embodiments a bullet is seated to contact the rifling does not move when the pressure is low, and has no opportunity to gain either velocity or angular momentum before entering the rifling. As a result, the pressure spikes to overcome the static friction force present on the bullet already in contact with the rifling. In some embodiments the increased pressure increases the bullet velocity, but the pressure may be dangerously excessive.

Different bullets are optimized with different twist rates. Twist is commonly expressed in terms of the 'travel' required to complete one full projectile revolution in the rifled barrel. Under or over stabilization will reduce accuracy and effectiveness. Under-stabilized bullets will tend to yaw and tumble through the air, creating drag and reducing range and ultimately striking a target in a random orientation. Over-stabilized bullets experience lateral thowoff, or the accentuation of bullet defects which cause a change to the center of mass or center of pressure and thus cause the bullet to behave unpredictably. Similarly, defects in the surface of the bullet will change the bullet's aerodynamics, again causing the bullet to behave unpredictably. Over-stabilized bullets magnify these static and dynamic defects.

While larger diameter bullets provide more stability due to their larger radius and thus greater gyroscopic inertia, long bullets are harder to stabilize, as the distance between the center of pressure and the center of mass create a longer moment of force. As a result the bullet is backheavy and the aerodynamic pressures have a longer lever arm to act on. Twist rate range from smooth bore (zero twist) to 1 in 72 for a muzzleloader shooting a round ball to 1 in 7 for 5.56×45 mm NATO SS109. AR-15 rifles are commonly found with 1 in 12 inches for older rifles and 1 in 9 inches for newer rifles, although some are made with 1 in 7 inches twist rates. As a result, optimized accuracy requires the minimum amount of required twist and not over twist or under twist.

In addition over-stabilized projectiles can accelerate barrel wear, and when coupled with high velocities can cause projectile jacket ruptures leading to in-flight disintegration. Smokeless powder can produce muzzle velocities of approximately 5,200 ft/s for spin stabilized projectile. Over-stabilized projectiles also cause more subtle problems with accuracy: Any defect or inconsistency within the bullet, such as a void that causes an unequal distribution of mass, may be magnified by the spin. Undersized bullets also have problems, as they may not enter the rifling exactly concentric and coaxial to the bore, and excess twist will exacerbate the accuracy problems this causes.

A bullet fired from a rifled barrel can spin at over 300,000 rpm, depending on the bullet's muzzle velocity and the barrel's twist rate. Excessive rotational speed can exceed the bullet's designed limits and the resulting centrifugal force can cause the bullet to disintegrate radially during flight.

Upon exiting the muzzle the projectile experiences a number of destabilizing forces. These forces are called external ballistics. External ballistics deal primarily with gravity, drag, and wind. Gravity pulls a projectile towards the earth as soon as the projectile exits the muzzle of a gun causing it to drop from the line of sight. Drag, or the air resistance, decelerates the projectile with a force proportional to the square of the velocity. Wind makes the projectile deviate from its trajectory. During flight, gravity, drag, and wind have a major impact on the path of the projectile, and must be accounted for when predicting how the projectile will travel.

For medium to longer ranges and flight times, besides gravity, air resistance and wind, several variables have to be taken into account for small arms. For long to very long small arms target ranges and flight times, minor effects and forces become important and have to be taken into account. The practical effects of these minor variables are generally irrelevant for most firearms users, since normal group scatter at short and medium ranges prevails over the influence these effects exert on projectile trajectories.

In general, a pointed projectile will have a better drag coefficient (Cd) or ballistic coefficient (BC) than a round nosed bullet, and a round nosed bullet will have a better Cd or BC than a flat point bullet. Large radius curves, resulting in a shallower point angle, will produce lower drags, particularly at supersonic velocities. Hollow point bullets behave much like a flat point of the same point diameter. Projectiles designed for supersonic use often have a slightly tapered base at the rear, called a boat tail 30, which reduces air resistance in flight. Cannelure 20, the recessed ring(s) around the projectile used to crimp the projectile securely into the case, will cause an increase in drag.

Gyroscopic drift is an interaction of the bullet's mass and aerodynamics with the atmosphere. Even in completely calm air, with no sideways air movement at all, a spin-stabilized projectile will experience a spin-induced sideways component, due to a gyroscopic phenomenon known as "yaw of repose." For a right hand (clockwise) direction of rotation this component will always be to the right. For a left hand (counterclockwise) direction of rotation this component will always be to the left. This is because the projectile's longitudinal axis (its axis of rotation) and the direction of the velocity vector of the CM deviate by a small angle, which is said to be the equilibrium yaw or the yaw of repose. The magnitude of the yaw of repose angle is typically less than 0.5 degree. Since rotating objects react with an angular velocity vector 90 degrees from the applied torque vector, the bullet's axis of symmetry moves with a component in the vertical plane and a component in the horizontal plane; for right-handed (clockwise) spinning bullets, the bullet's axis of symmetry deflects to the right and a little bit upward with respect to the direction of the velocity vector, as the projectile moves along its ballistic arc. As the result of this small inclination, there is a continuous air stream, which tends to deflect the bullet to the right. Thus the occurrence of the yaw of repose is the reason for the bullet drifting to the right (for right-handed spin) or to the left (for left-handed spin). This means that the bullet is "skidding" sideways at any given moment, and thus experiencing a sideways component.

A number of variables affect the magnitude of gyroscopic drift. Longer projectiles or bullets will experience more gyroscopic drift because the body of the bullet produces more lateral "lift" for a given yaw angle. The spin rate also affects drift because faster spin rates will produce more gyroscopic drift as the nose ends up pointing farther to the side. Similarly range, time of flight and trajectory height can increase gyroscopic drift. Finally, air density due to factors such as humidity and temperature can increase gyroscopic drift.

Another force exerted on a spinning projectile is called the Magnus effect. This occurs as the spin of the bullet creates a force acting either up or down, perpendicular to the sideways vector of the wind. In the simple case of horizontal wind, and a right hand direction of rotation, the Magnus effect induced pressure differences around the bullet cause a downward or upward force (depending on wind direction) viewed from the point of firing to act on the projectile, affecting its point of impact. The Magnus effect is generally marginal, however it may be significant if wind speed is greater than 9 mph.

The Magnus effect has a significant role in bullet stability because the Magnus force does not act upon the bullet's center of gravity, but the center of pressure affecting the yaw of the bullet. The Magnus effect will act as a destabilizing force on any bullet with a center of pressure located ahead of the center of gravity, while conversely acting as a stabilizing force on any bullet with the center of pressure located behind the center of gravity. The location of the center of pressure depends on the flow field structure ie the shape and other attributes of the bullet. In any case the Magnus force greatly affects stability.

In contrast, very-low-drag ("VLD") bullets due to their length have a tendency to exhibit greater Magnus destabilizing errors because they have a greater surface area to present to the oncoming air they are travelling through, thereby reducing their aerodynamic efficiency. This subtle effect is one of the reasons why a calculated Cd or BC based on shape and sectional density is of limited use.

The twist in a bore sets the bullet's rate of spin, which directly and significantly impacts the external ballistics affecting a bullet. Twist significantly affects accuracy. Changes as small as ½ inch in twist can significantly impact bullet accuracy.

Ogive Grooves

In some embodiments bullet 5 comprise an ogive 10 to improve bullet 5 performance. In some embodiments the ogive 10 comprises a spiral pattern of grooves machined into the surface of the ogive 10. In some embodiments once a bullet 5 is fired the grooves cause the bullet 5 to begin to spin, thus reducing the strike force caused by the bullet 5 entering the rifling. In some embodiments the ogive grooves 15 constructively extend the barrel's rifling 40 even though the bullet 5 is not in contact with the rifling and the bullet 5 has not entered the bore. In some embodiments the ogive grooves 15 cause the bullet 5 to spin before it enters the bore of a barrel, causing the projectile to spin around its longitudinal axis during flight. Spin gyroscopically stabilizes the projectile by conservation of angular momentum, improving its aerodynamic stability and accuracy.

In some embodiments the ogive grooves 15 spiral is expressed in a twist rate of turns per inch to either the right or left. Ogive groove 15 is described by its twist rate ie the distance the spiral takes to complete one full revolution. In some embodiments, as with barrel rifling, ogive groove 15 is often expressed as "1 turn in 10 inches" (1:10 inches). Shorter distance indicates a "faster" twist, meaning that for a given velocity the projectile will be rotating at a higher spin rate.

In some embodiments the length, weight and shape of a projectile dictate the required twist rate needed to stabilize it in flight. Larger caliber bullets are stable at slower twist rates, while higher caliber bullets require more twist to remain stable through flight. In some embodiments twist rate may range from a very from 1 in 7½, 1 in 8, 1 in 8¼, or 1 in 8½. In some embodiments the objective is to match the twist in the barrel being used to fire the bullet.

In some embodiments the grooves can also take the shape of a polygon, usually with rounded corners. In some embodiments ogive grooves 15 may be described by the groove width, groove shape, groove taper, or groove profile. In some embodiments ogive grooves 15 are manufactured with a wide variety of grooves, odd or even number of grooves and grooves in different shapes. In some embodiments ogive grooves 15 are manufactured with two ogive grooves 15, three ogive grooves 15, four ogive grooves 15, five (5) ogive grooves 15, six ogive grooves 15, seven ogive grooves 15 and eight ogive grooves 15. In some embodiments bullets are manufactured with 12, 16, 22 and 24 ogive grooves 15.

The number and depth of ogive grooves 15 directly impacts the internal and external ballistics. In some embodiments ogive grooves 15 create spin before entering the bore rifling. In some embodiments ogive grooves 15 cover $5/8^{th}$ of the ogive 10. In some embodiments four-groove, six-groove and eight-groove bullets have ogive grooves 15 that are a fraction the width of the two-groove bullets and use $1/4^{th}$ of the circumference of the ogive 10. In some embodiments the grooves cover $1/4^{th}$ of the ogive 10 circumference and guide the projectile such as a cast bullet. In some embodiments optimized performance requires ogive groove-sized bodies and optimized bullet 5 lengths. In some embodiments the width of the ogive grooves 15 and non-grooved ogive 10 surface is equal, with each occupying ½ of the ogive 10 surface. In some embodiments ogive grooves 15 shift the center of pressure forward while creating an envelope in which the bullet 5 travels, off-setting other external ballistic forces acting on the bullet 5 in flight. In some embodiments, matching the ogive grooves 15 to the barrel twist conserves the energy required to change from a first spin rate to a second spin rate.

Ogive grooves 15 are normally in the area of 0.004 to 0.006 inches in depth. In some embodiments ogive groove 15 depth ranges from 0.006 to 0.010 inches. In some embodiments ogive groove 15 depth ranges from 0.010 to 0.015 inches. In some embodiments shallow grooves maintain a forward center of pressure, while deep ogive grooves 15 shift the center of pressure further back, thus reducing the moment arm being exerted on the bullet. In some embodiments shifting the moment arm towards the back of the bullet 5 ameliorates the destabilizing forces being exerted on longer bullets. In some embodiments ogive grooves 15 are rounded. In some embodiments ogive grooves 15 are wider than the lands. In some embodiments ogive grooves 15 are parabolic. In some embodiments ogive grooves 15 are gain twist, where the grooves increases in twist as it advances from across the ogive 10, however, practically speaking, the limited space of the ogive 10 may limit the gain. In some embodiments ogive groove changes groove depth as it progresses across the ogive 10.

In some embodiments ogive grooves 15 aid rifling to accurately deliver the projectile to the target by maintaining bullet 5 spin. In some embodiments bullet 5 spin is maintained as the ogive grooves 15 initiate spin as the bullet 5 is fired from the casing, helping to initiate spin before the bullet 5 is delivered to the rifling in the barrel. In some embodiments the ogive grooves 15 are consistent down the length of the ogive 10. In some embodiments the ogive grooves 15 are tapered down the length of the ogive 10. In some embodiments the ogive grooves 15 are set start at the tip of the ogive 10 and move back to the shoulder. In some embodiments the ogive grooves 15 cover only a portion of the length of the ogive 10. In some embodiments the ogive grooves 15 have changes in cross-section, such as variations in groove width or spacing.

In some embodiments the ogive grooves 15 do not contact the rifling, but constructively extend the rifling 40 toward the breech beyond the end of the bore by matching the twist in the rifling. In some embodiments, the constructive extension of the barrel 40 is accomplished by asserting the twist force on the bullet 5 without the barrel rifling being in actual physical contact with the bullet. In some embodiments the constructive barrel extension 40 extends through an unrifled leade or throat ahead of the chamber. In some embodiments the ogive grooves 15 constructively extend the barrel twist 40 through the free-bore to maximize the powder burn before the rifling contacts and slows the bullet 5 as the bullet 5 to transitions from static friction to sliding friction and gain linear momentum prior to encountering the resistance of increasing rotational momentum. In some embodiments, constructively extending the barrel twist 40 though the free-bore allows more effective use of propellants by reducing the initial pressure peak during the minimum volume phase of internal ballistics before the bullet 5 starts moving down the barrel.

In some embodiments free-bore improves ballistics by allowing the bullet 5 to leave the casing straight and overcoming its inertia and reaching a higher velocity prior to encountering the rifling. In some embodiments the resistance force created by the bullet 5 engaging the rifling is more easily overcome when the bullet 5 is properly aligned and the bullet 5 hits the bore at speed.

In some embodiments a firearm firing system comprising a rifle barrel having a twist; and a bullet 5 comprising an ogive 10 wherein grooves are formed on the ogive 10 in a turn radius that approximately matches the twist in the rifle barrel. In some embodiments the grooves are spiral. In some embodiments the grooves are aligned offset so that no two grooves are aligned on opposite sides of the ogive 10. In some embodiments the ogive grooves 15 are aligned equidistant around the ogive 10. In some embodiments the area of ogive grooved surface and the area of the non-grooved surface are approximately equal such that the width of the groove is approximately equal the non-grooved surface of the ogive 10.

In some embodiments ogive grooves 15 are formed by pressing a finished bullet. In some embodiments ogive grooves 15 are formed by machining completed bullets. In some embodiments. In some embodiments ogive grooves 15 can be formed in all types of projectiles structures including, but not limited to lead-core, solid copper and cast lead. In some embodiments ogive grooves 15 are formed in the jacket and the core conforms to the shape of the ogive grooves 15. In some embodiments ogive grooves 15 are engraved on the bullet. In some embodiments ogive grooves 15 are etched into the bullet. In some embodiments ogive grooves 15 are laser cut into the bullet. In some embodiments ogive grooves 15 are scribed into the bullet. In some embodiments ogive grooves 15 are formed by depositing materials on the bullet; however, when material is deposited the amount of material is limited so as to not make contact with the barrel lands during firing. In some embodiments chemical deposition techniques are used to deposit material in the shape of ogive grooves 15. In some embodiments material is physically deposited using mechanical, electromechanical or thermodynamic means. Physical deposition may include physical vapor deposition, molecular beam epitaxy, pulsed laser deposition, cathodic arc deposition, or powder coatings. In these methods the jacket material may be processed before being applied to the bullet 5 core. In some embodiments the deposited materials comprising the ogive grooves 15 will travel with the bullet 5 impacting the bullet's external ballistics. In some embodiments the ogive grooves 15 will remove from the ogive 10 after firing so ameliorate the impact the material has on flight. In some embodiments the material may be flammable so it substantially burns off the ogive 10 while in the bore.

In some embodiments the area of ogive grooved surface is greater than the area of non-grooved surface. In some embodiments the ogive-grooved surface area is greater than the non-grooved ogive 10 surface. In some embodiments the ogive grooves 15 formed in the surface of the ogive grooves 15 are between 0.00095 inches and 0.02 inches which shallow grooves between 0.004 and 0.006 inches. In some embodiments the ogive grooves 15 depth is tapered from 0.000 inches to about 0.006 inches from one portion of the ogive groove to another. In some embodiments the ogive grooves 15 are shallower towards the nose of the bullet. In some embodiments the ogive grooves 15 are narrower towards the nose of the bullet. In some embodiments the ogive grooves 15 are shallower towards the shoulder of bullet. In some embodiments the ogive grooves 15 are narrower towards the shoulder of the bullet. In some embodiments the ogive grooves 15 are formed on bullets fired from rifles. In some embodiments the ogive grooves 15 are formed on bullets fired from handguns.

In some embodiments the ogive surface area is increased. In some embodiments an ogive grooved bullet with twist matching the bullet twist flattens the bullet trajectory. In some embodiments a standard bullet is shot at a first distance, followed by a second bullet comprising ogive grooves matching the barrel twist wherein the second bullet it's the target significantly higher than the first bullet. In some embodiments the increased surface area improves the ballistic coefficient.

Some embodiment comprise a method of constructively extending the barrel rifling 40 beyond the physical barrel by providing a bullet 5 with a plurality of grooves therein which match the twist in a gun barrel being used to fire the bullet. In some embodiments the grooves are formed on the ogive 10 of the bullet. In some embodiments the method comprises forming ogive grooves 15 where at least a portion of the groove matches the groove depth in the barrel rifling. In some embodiments the method comprises forming ogive groves that have the same cross-sectional shape as the grooves and lands in the barrel. In some embodiments the ogive grooves 15 comprise the same spacing and distribution as the lands and grooves in the barrel. In some embodiments the ogive grooves 15 are aligned on opposite sides of the ogive 10.

In some embodiments the method comprises improving the internal ballistics of a bullet 5 fired bullet 5 such that the bullet 5 is configured to begin to spin before it makes contact with the lands in the barrel. In some embodiments the method comprises improving the external ballistics by providing ogive groves which match the twist of the rifle from which the bullet 5 is fired such that the bullet 5 is configured to maintain the spin of the rifle after the bullet 5 leaves the barrel.

In some embodiments the method comprises forming ogive grooves 15 in a bullet 5 which are between 0.004 inches and 0.015 inches deep. In some embodiments the method comprises tapering ogive groove depths or widths. In some embodiments the method comprises firing the bullet 5 from a handgun.

In closing, it is to be understood that the embodiments of the disclosure disclosed herein are illustrative of the principles of the present disclosure. Other modifications that may be employed are within the scope of the disclosure. Thus, by way of example, but not of limitation, alternative configurations of the present disclosure may be utilized in accordance with the teachings herein. Accordingly, the present disclosure is not limited to that precisely as shown and described.

The invention claimed is:

1. A firearm firing system comprising:

a rifle barrel having a twist; and a bullet comprising an ogive wherein grooves are formed on the entire length of the ogive between the nose and the shoulder in a turn radius that substantially matches the twist in the rifle barrel.

2. The grooves of claim 1 wherein the grooves are spiral.

3. The grooves of claim 1 wherein groove is aligned opposite another groove.

4. The grooves of claim 1 wherein the area of ogive grooved surface and the area of the non-grooved surface are approximately equal.

5. The grooves of claim 1 wherein the area of ogive grooved surface is greater is greater than the area of non-grooved surface.

6. The grooves of claim 1 wherein the ogive-grooved surface area is greater than the non-grooved ogive surface.

7. The system of claim 1 wherein the ogive grooves formed in the surface of the ogive are between 0.004 inches and 0.015 inches.

8. The grooves of claim 1 wherein the groove depth is tapered from one end of the groove to another.

9. The firearm projectile of claim 1 wherein the firearm projectile is a handgun bullet.

10. A method of constructively extending the rifling of a barrel beyond the breech end of the barrel and onto the surface of the ogive the method comprising:

providing a bullet having an ogive extending between a nose and a shoulder wherein a plurality of grooves extending the full length of the ogive surface match the twist in a gun barrel configured to fire the bullet.

11. The method of claim 10 comprising a bullet having an ogive wherein spiral grooves are formed in the ogive.

12. The method of claim 10 comprising aligning the grooves on opposite sides of the ogive.

13. The method of claim 10 comprising improving the internal ballistics when firing the bullet such that the bullet is configured to begin to spin before it makes contact with the lands in the barrel.

14. The method of claim 10 further comprising improving the external ballistics by providing ogive groves which match the twist of the rifle from which the bullet is fired such that the bullet is configured to maintain the spin of the rifle after the bullet leaves the barrel.

15. The method of claim 10 comprising forming ogive grooves in bullet which are between 0.004 inches and 0.015 inches deep.

16. The method of claim 10 comprising tapering ogive groove depths.

17. The method of claim 10 comprising firing the bullet from a handgun.

18. A bullet comprising: a nose, a bearing surface and a heel wherein an ogive connects the nose and the bearing surface and a boat tail connects the bearing surface and the heel; wherein the ogive further comprises spiral lacunae formed in the ogive surface extending the full length of the ogive between the nose and the shoulder in a twist rate configured to exactly match the twist of a gun barrel which is intended to be used for firing the bullet.

19. The bullet of claim 18 wherein the lacunae have a cross-sectional profile that is angular and shelved.

* * * * *